US005432540A

United States Patent [19]

Hiraishi

[11] Patent Number: 5,432,540

[45] Date of Patent: Jul. 11, 1995

[54] INK JET HEAD

[75] Inventor: Hisato Hiraishi, Tokyo, Japan

[73] Assignee: Citizen Watch Co., Ltd., Tokyo, Japan

[21] Appl. No.: 21,944

[22] Filed: Feb. 24, 1993

[30] Foreign Application Priority Data

Feb. 25, 1992 [JP] Japan ..... 4-073154
May 21, 1992 [JP] Japan ..... 4-153006

[51] Int. Cl.[6] ..... B41J 2/045; B41J 2/055
[52] U.S. Cl. ..... 347/69; 347/94
[58] Field of Search ..... 346/140 R; 347/69, 94; B41J 2/045, 2/055

[56] References Cited

U.S. PATENT DOCUMENTS 4,568,953 2/1986 Aoki et al. ..... 346/140 R

FOREIGN PATENT DOCUMENTS 3-293143 12/1991 Japan ..... B41J 2/045
4-175167 6/1992 Japan ..... B41J 2/045
4-241949 8/1992 Japan ..... B41J 2/045

*Primary Examiner*—Benjamin R. Fuller
*Assistant Examiner*—Alrick Bobb
*Attorney, Agent, or Firm*—Wenderoth, Lind & Ponack

[57] ABSTRACT

In a shear mode type ink jet head, nozzle holes are disposed at substantially central portions of channels formed between barriers of piezoelectric material, and common ink reservoirs are provided at both ends of the channels. In one embodiment, two kinds of channels having different depths are formed in alternating succession on a board made of piezoelectric material. Channels of one depth are used as dummy channels and are kept empty, and channels of the other depth are filled with ink and the ink can be ejected from the channels through nozzle holes.

5 Claims, 11 Drawing Sheets

INK JET HEAD

BACKGROUND OF THE INVENTION

1. Field of the Invention

The present invention relates to a drop-on-demand (hereinafter abbreviated DOD) type ink jet head.

2. Description of the Prior Art

Among non-impact printers for which the market has been rapidly increasing, the simplest is an ink jet printer which is suitable for color printing, and there is also the so-called DOD type ink jet printer which ejects an ink droplet to form a dot and is the current standard among non-impact. Typical DOD type ink jet printers include a Kyser type which is disclosed in Japanese Patent Publication No. 12138/1978 and a thermal jet type which is disclosed in Japanese Patent Publication No. 59914/1986. However, these conventional printers have difficulties in that miniaturization of the device is difficult in the former and ink tends to be burnt due to the application of intense heat in the latter.

So as to simultaneously overcome the above-described defects, Japanese Laid-Open Patent Publication No. 252750/1988 proposes a shear mode type ink jet head. The structure and the operating principle will be described with reference to FIGS. 9(*a*) and 9(*b*). FIG. 9(*a*) is a cross-sectional view illustrating the structure when not being driven and in which barriers 95*ab*, 95*bc* and 95*cd* are adhered on an insulating board 91 made of glass or ceramic at regular intervals and in parallel with each other to form a number of narrow channels 92*a*, 92*b* and 92*c* which form an ink chamber and ink passages. One end of each of the channels 92*a*, 92*b* and 92*c* is designed so that ink can be supplied from a common ink reservoir. The other end is adhered to a nozzle plate which has small nozzle holes 93*a*, 93*b* and 93*c* formed therein. Furthermore, the barriers are flexibly adhered to a cover 98 made of glass or ceramic by intervening elastic members 21. Here, the barriers are made of a piezoelectric material such as lead zirconate titanate (PZT) and are polarized in one direction as shown by an arrow 22 or in a direction opposite the arrow 22. On the wall surfaces of the respective barriers are formed electrodes 94*a*2, 94*b*1, 94*b*2 and 94*c*1. Subsequently, if a sufficient magnitude of positive electric potential with respect to the electrode 94*b*1 is applied to the electrode 94*a*2 of FIG. 9(*a*), the barrier 95*ab* undergoes a shear mode deformation as shown in FIG. 9(*b*). If an identical operation is performed on the barrier 95*bc*, wherein the electrodes 94*b*1 and 94*b*2 usually have an identical electric potential, the cross-section of the channel 92*b* for the ink chamber and the ink passage is reduced from the initial state of FIG. 9(*a*) to the state of FIG. 9(*b*). Namely, if ink is charged in the channel, the pressure of the ink is instantaneously raised to eject an ink droplet from the nozzle hole 93*b*.

FIG. 8 is a perspective view of the ink jet head thus formed and is similar to the one disclosed in Japanese Laid-Open Patent Publication No. 252750/1988. This head comprises barriers 85 made of a piezoelectric material and which are adhered to an insulating board 81, narrow channels 82 constituting an ink chamber and an ink passage, a nozzle plate 80 which is adhered to the channels so as to close ends thereof, and a cover 88 which covers the entire portion having the channels therein. Nozzle holes 83 open through the nozzle plate and eject ink droplets as described in connection with FIGS. 9(*a*) and 9(*b*). Further, the ink is introduced from an ink-supplying inlet 86 and is supplied to the respective channels through a common ink reservoir 87.

OBJECTS AND BRIEF SUMMARY OF THE INVENTION

In the case of the head structure shown in FIG. 8, the ink droplets are ejected from the nozzle holes 83 by the pressure produced in the narrow channels 82. But the fluid resistance in these channels can be ignored because of its very narrow structure. This fluid resistance causes a great loss in the pressure produced in the channel, which is finally changed to a thermal energy and causes the problem that the ejection rate of the ink droplets is significantly decreased. This decrease in the ejecting rate induces the instability in the direction of ejection of the ink droplets and does not only cause a positioning deviation of the printed dots, but also causes the fatal defect of having errors in the printed dots. The importance of this problem is attributed to the fact that the magnitude of the fluid resistance increases substantially in inverse proportion to the fourth power of the pitch when making the pitch of the nozzle narrow, wherein the cross-sectional configurations of the channels are assumed to be similar figures and the degree of the decrease in the ejecting rate is made significant by using a head for high-density printing. On the other hand, it is necessary to have high-density printing to obtain high-quality printing. It is an object of the present invention to obviate the decrease in ejecting rate of ink droplets due to such a conventional head structure and to provide an ink jet head which produces highly reliable and high-quality printing.

So as to achieve the above object, nozzle holes which have been conventionally disposed at ends of narrow channels for an ink chamber and an ink-flowing passage as shown in FIG. 8 are disposed at substantially central portions of the channels, and common ink reservoirs are provided at both ends of the channels in the present invention.

Furthermore, the shear mode type ink jet head disclosed in the above-described Japanese Patent Publication No. 252,750/1988 has the following defects. Though the description overlaps with the previous description, the structure and the operation principle will be described with reference to FIGS. 16 and 17.

FIG. 16 is a cross-sectional view illustrating the ink jet head structure when not being driven and in which a number of narrow channels 72*a*, 72*b* and 72*c* are formed on a board 1 made of a piezoelectric material such as lead zirconate titanate (PZT) at regular intervals and in parallel with each other. The upper surfaces of barriers 75*ab*, 75*bc* and 75*cd* remaining between the channels are flexibly adhered to a cover 78 made of glass, ceramic or plastic by intervening elastic members 21. As a result, the channels work as narrow channels constituting ink chambers and ink-flow passages. One end of each of the channels 72*a*, 72*b* and 72*c* is designed so that ink can be supplied from a common ink reservoir, and the other end is adhered to a nozzle plate having small nozzle holes 73*a*, 73*b* and 73*c*. The board made of a piezoelectric material and including the barriers is polarized in one direction as shown by an arrow 9 or opposite thereto. On the inner surfaces of the respective channels are formed electrodes 74*a*, 74*b* and 74*c*.

Here, if a sufficient magnitude of positive electric potential with respect to the electrode 74*b* is applied to the electrode 74*a* of FIG. 16, the barrier 75*ab* undergoes a shear mode deformation resulting from crossing of the lines of electric force 89*a* and polarization 9 in the barrier. If the identical operations are performed on the barrier 75*bc*, the cross section of the channel for the ink chamber and the ink-flow passage is reduced from the initial state of FIG. 16 to the state of FIG. 17. Namely, if ink is charged in the channel 72*b*, the pressure of the ink is instantaneously raised to eject an ink droplet from the nozzle hole 73*b*.

So as to produce a pure deformation in the shear mode as shown in FIG. 17, it is preferred that the electric field between the electrodes 74*a* and 74*b* is concentrated only in the barrier 75*b*. However, the lines of the electric force 89*b* are actually produced by the leakage of the electric field to the base of the board 1. At and near the bottom of the channel 72*b*, the lines of the electric force 89*b* are substantially parallel to the polarization 9 in the base and turn to the same direction. Thus, a stretching deformation is produced in this direction to raise the bottom portion of the channel 72*b* as shown by a single dot line 90. On the other hand, at and near the bottom of the channel 72*a*, the lines of electric force 89*b* are substantially parallel to the polarization 9 and turn to the reverse direction, which causes a shrinkage deformation in this direction and produces a depression at the bottom portion as shown by a single dot line 90. Such a problem was already discussed in Japanese Patent Publication No. 150355/1990.

Such a deformation at the base of the board acts in a direction to suppress the shear mode deformation of the barriers 75*ab* and 75*bc*. This can be readily appreciated from FIG. 17, which, in turn, decreases an ejecting force when used as an ink jet head. On the other hand, the bottom portion of the channel 72*b* is raised to reduce the cross section of the channel, whereby we can expect the effect to increase the ejecting force. Thus, the present inventors measured a displacement amount of the barrier 75*ab* by means of laser instrumentation and measurement. This experiment was performed by adhering a minute mirror on the upper surface of the barrier and measuring movement of the mirror by using laser light irradiated to the mirror, while changing the voltage applied to the electrodes of both channels on the sides of the barrier, and converting the movement into the deformation amount of the barrier. By this experiment, it was ascertained that the suppressing effect is dominant. This result shows that the volume change of the channel 72*b* in FIG. 17 is considerably reduced and amounts to substantially $\frac{2}{3}$, as compared with the case where only an imaginary shear mode is present. As a result, the ink ejecting force from the nozzle hole 73*b* is greatly reduced, which causes the problem of a decrease in the ejecting rate of ink droplets. This decrease in the ejecting rate induces the instability of the direction in which the ink droplet is ejected and, does not only cause a positioning deviation of the printed dots, but also makes it impossible to eject the ink which is made highly viscous near the nozzle hole and causes the fatal defect of having errors in the printed dots.

It is an object of the present invention to obviate the defect constituted by the decrease in ejecting rate of ink droplets due to such a conventional head, and to provide an ink jet head which produces highly reliable and high-quality printing.

So as to achieve the above objects, in accordance with the present invention, a dummy channel which does not eject ink is disposed midway between adjacent channels, while narrow channels which serve as the ink channels has been conventionally disposed in parallel so that they are adjacent to each other. Furthermore, the depth of the dummy channels is made different from that of the narrow ink-ejecting channels.

DESCRIPTION OF THE PREFERRED EMBODIMENT

Now, the embodiments of the present invention will be explained with reference to the accompanying drawings.

Embodiment 1

Figure 1:
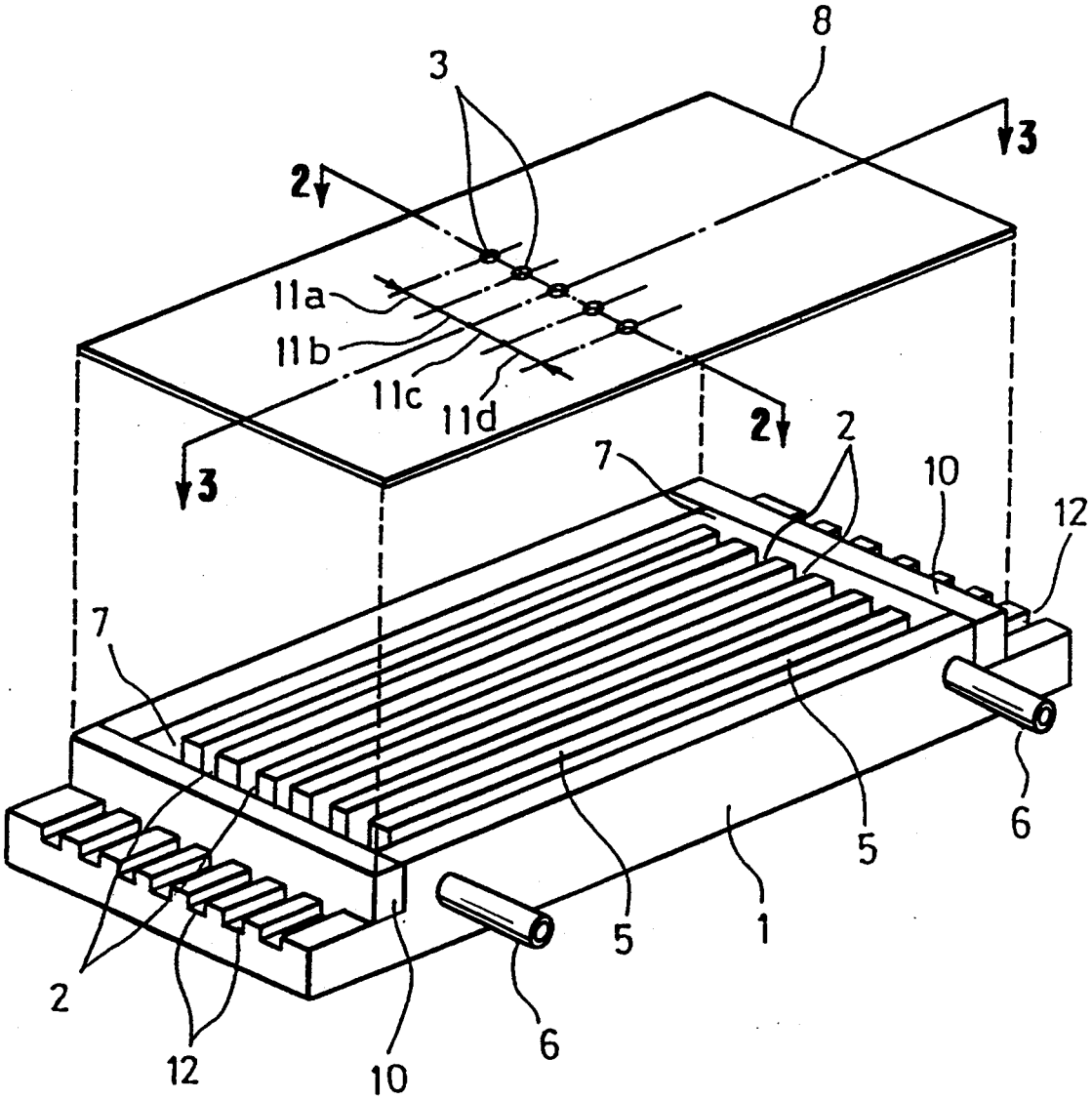
FIG. 1 is a perspective view illustrating the first embodiment of an ink jet head according to the present invention.
Figure 8:
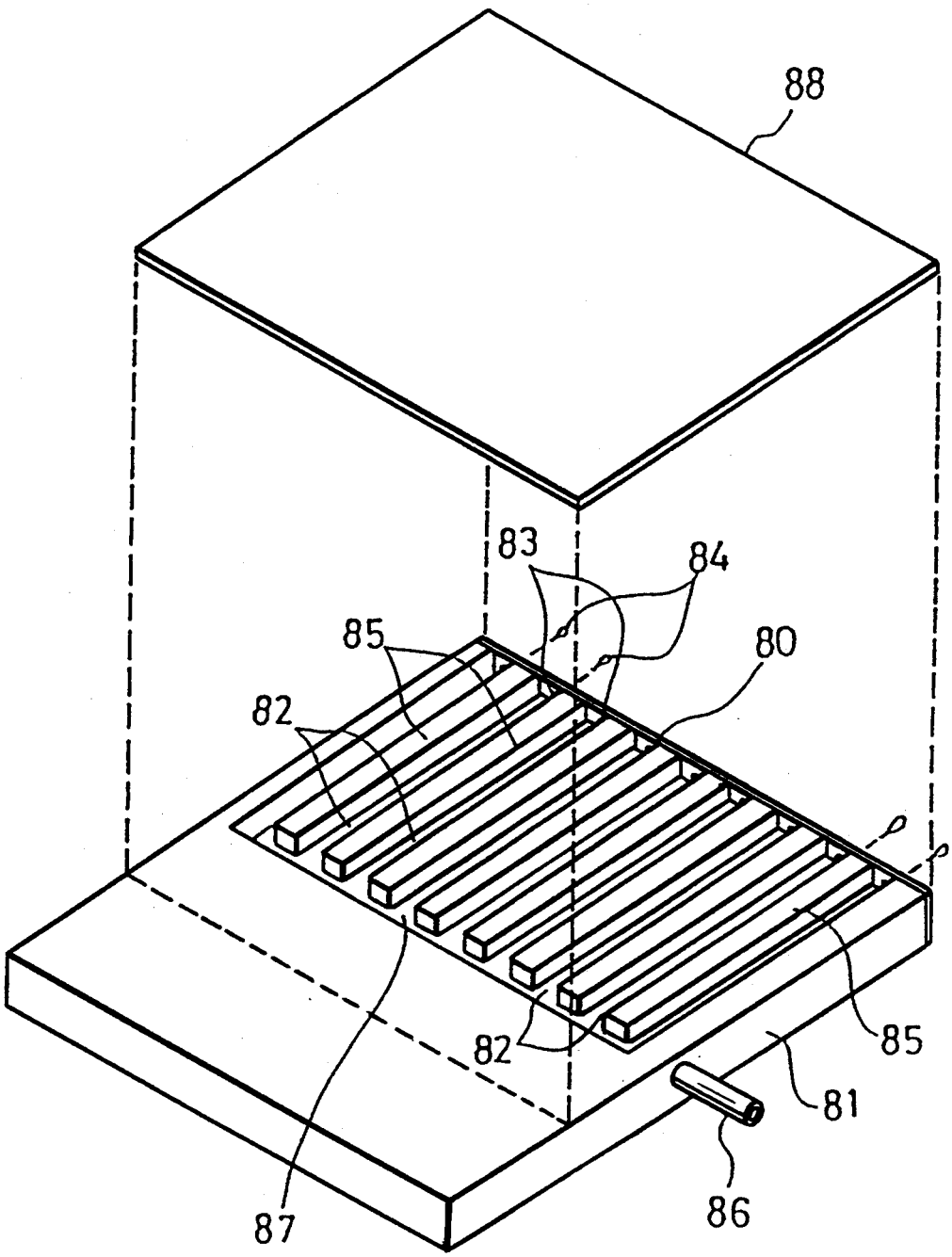
FIG. 8 PRIOR ART
FIG. 8 is a perspective view illustrating the prior art.

FIG. 1 shows an embodiment of an ink jet head structure according to the present invention. In this preferred embodiment, a board 1 is made of a piezoelectric material by integrally molding the insulating board 81 and the barriers 85 made of a piezoelectric material. However, a modification thereof does not change the spirit of the present invention. Since the barriers 5 must be polarized in one direction in a manner similar to the FIG. 8 arrangement, practically the whole board 1 is polarized. When performing such an integral molding, a channel 2 for the ink chamber and ink-flow passage is usually made by a cutting process by use of a dicing saw. At opposing ends of the board 1, a step is formed so as to form shallow channels 12. The shallow channels 12 are provided to connect with outside electrodes by providing electrodes in the shallow channels 12 which are connected electrodes formed on the side surfaces of the barriers 5. A sealing plate 10 is mounted to each of the stepped portions to prevent the ink from escaping. The channels 2 are communicated with each other at both ends by a common ink reservoir 7. An upper plate 8 having nozzle holes 3 is mounted in such a manner that the nozzle holes 3 are disposed at substantially the central portions of the channels 2 constituting the ink chambers and ink-flow passages. Further, the upper plate 8 covers the channels 2 and the ink reservoir 7. This upper plate may be formed, for example, by separately providing a first part having nozzle holes 3 and a second part which acts as a cover for the ink reservoir 7. The ink is introduced through ink-supply inlets 6 and is supplied to the respective channels 2 through the common ink reservoirs 7.

Figure 2:
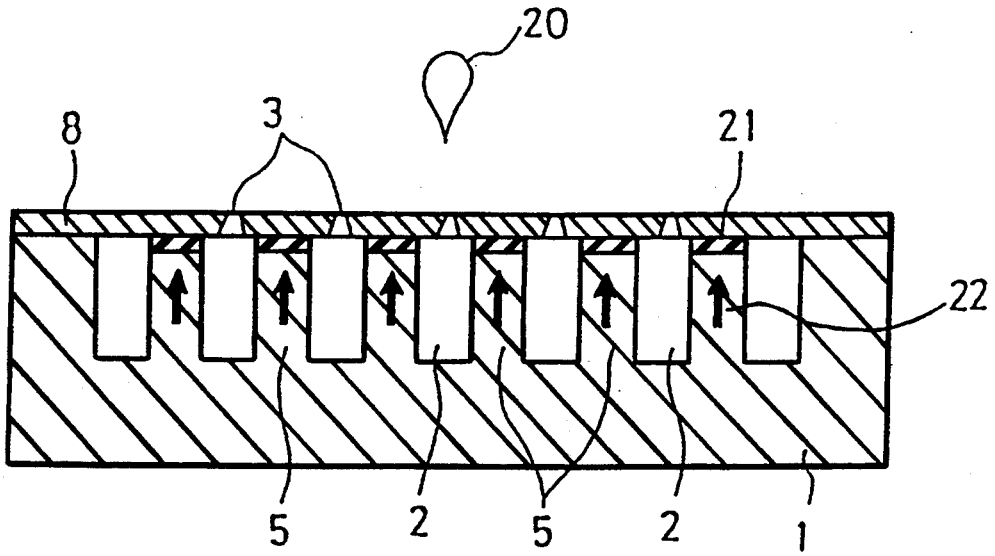
FIG. 2 is a cross-sectional view illustrating the first embodiment of an ink jet head according to the present invention.
Figure 3:
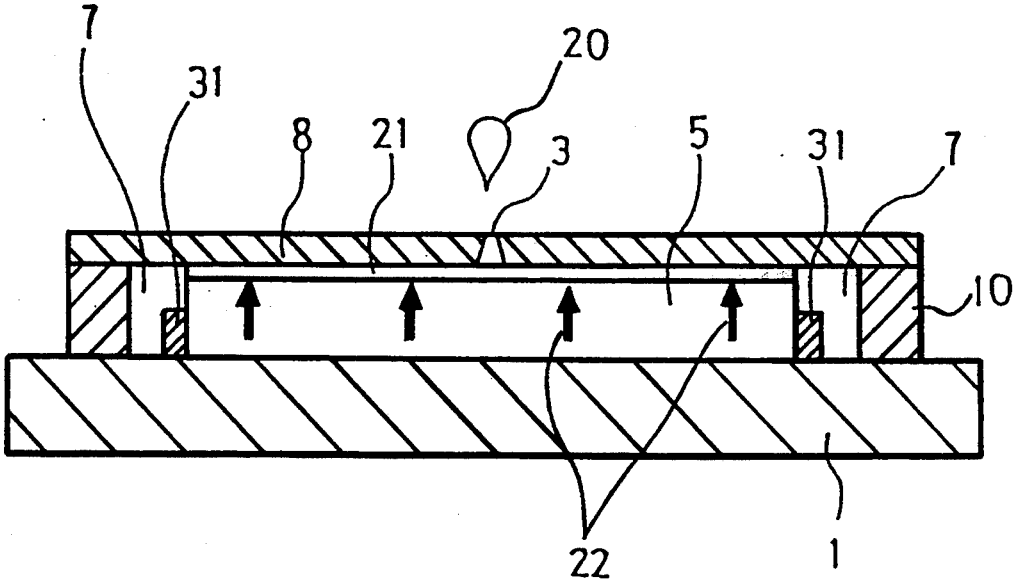
FIG. 3 is a cross-sectional view illustrating the first embodiment of an ink jet head according to the present invention.
Figure 9A:
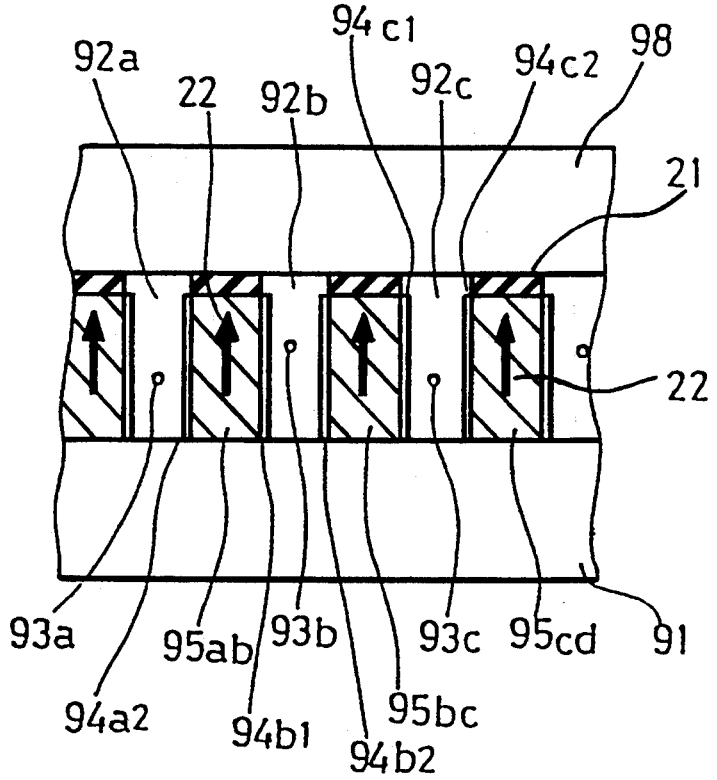
FIG. 9(a) PRIOR ART
FIGS. 9(*a*) and 9(*b*) are cross-sectional views illustrating the prior art.
Figure 9B:
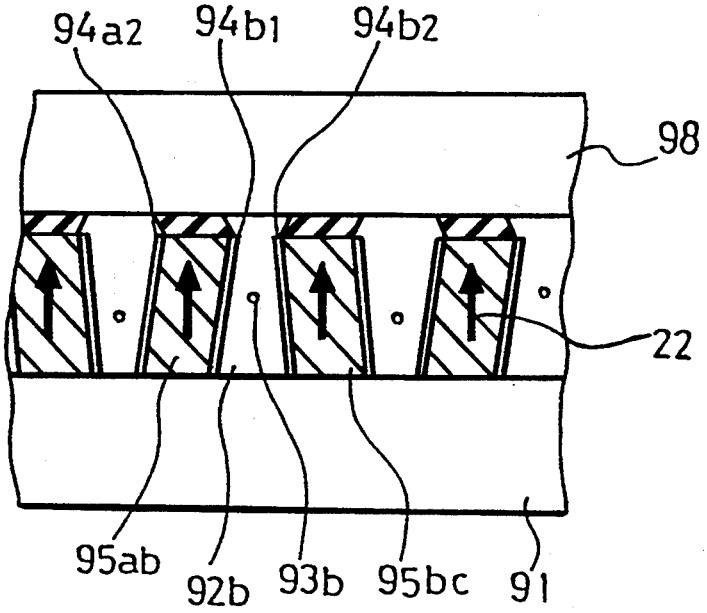
FIG. 9(b) PRIOR ART

FIGS. 2 and 3 are cross-sectional views taken substantially on lines 2—2 and 3—3 of FIG. 1, respectively. The board 1 made of a piezoelectric material is polarized at least in one direction in the barriers 5 as shown by arrows 22. The board 1 is adhered to the upper plate 8 by intervening elastic members 21. The upper surfaces of the barriers 5 may, however, be directly adhered to the bottom surface of the upper plate 8 without using the elastic members 21. The nozzle holes 3 is disposed substantially at the central portion of the narrow ink channels 2 as shown in FIG. 3o At the connecting portions between the common ink reservoirs 7 and the channels 2, obstacles 31 are provided for producing fluid resistance. The purpose in this is to effectively use the pressure generated in the channel during an ink ejecting operation. Thus the fluid resistance produced by the obstacle 31 may be preferred so long as the magnitude of the resistance is such that it does not hinder a steady ink supply from the common ink reservoirs 7. Electrodes similar to those shown in FIG. 9, are required although they are omitted in FIG. 3. An ink droplet 20 is ejected in a perpendicular direction with respect to the surface of the upper plate by driving one of the barriers 5 in a manner similar to that described in connection with FIG. 9.

Figure 4:
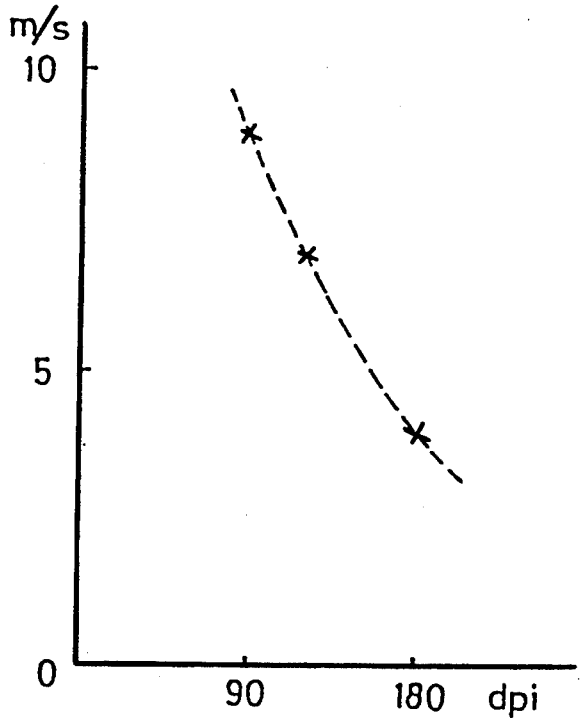
FIG. 4 is a view illustrating the operation of an ink jet head according to the present invention.

This structure makes it possible to solve the problem of the decrease in ink ejecting force caused by the fluid resistance of the narrow ink channels 2. FIG. 4 illustrates the change of ink ejecting force as an ejecting rate of the ink, when both ratio of the width to the depth of the channel and its length are kept constant, and the pitch of the channels formed at regular intervals is varied, wherein the pitch represents the number of channels per 1 inch by dpi. In this case, the significant decrease in ejecting rate of the ink when narrowing the pitch is judged to be mainly due to the effect of the fluid resistance, since the magnitude of the fluid resistance increases substantially in inverse proportion to the fourth power of its pitch. In practice, when using a head with a 180 dpi pitch according to the present invention, wherein the ratio of the width to the depth of the channels and its length are similar to those of the head illustrated in FIG. 4, an ejecting rate of 7 m/s is obtained. This is based on the fact that, with the present arrangement, the channel length from the common ink reservoir to the nozzle hole is effectively reduced to half and, thereby, the fluid resistance is reduced to half, and the number of channels leading to the nozzle hole is effectively 2. Thus, the fluid resistance is again reduced to half, such that the resultant fluid resistance is reduced to a quarter, as compared with the conventional structure.

The head is prepared as follows: A board 1 of PZT has a thickness of 1 mm, and the whole board 1 is polarized as shown by arrows 22 in FIG. 2. The board is subjected to a cutting process by using a dicing saw to form barriers 5 having a width of 70 μm and a height of 150 μm with a pitch of 141 μm. The channels have a length of 20 mm. On the side surfaces of the barriers are formed electrodes by laminating a film of chromium and gold having a total thickness of 0.8 mm by means of deposition. An upper plate 3 which is made of plastic and is provided with nozzle holes 3 having a diameter of 35 μm is adhered to the barriers by intervening elastic members 21 made of a silicone resin.

Embodiment 2

Figure 5:
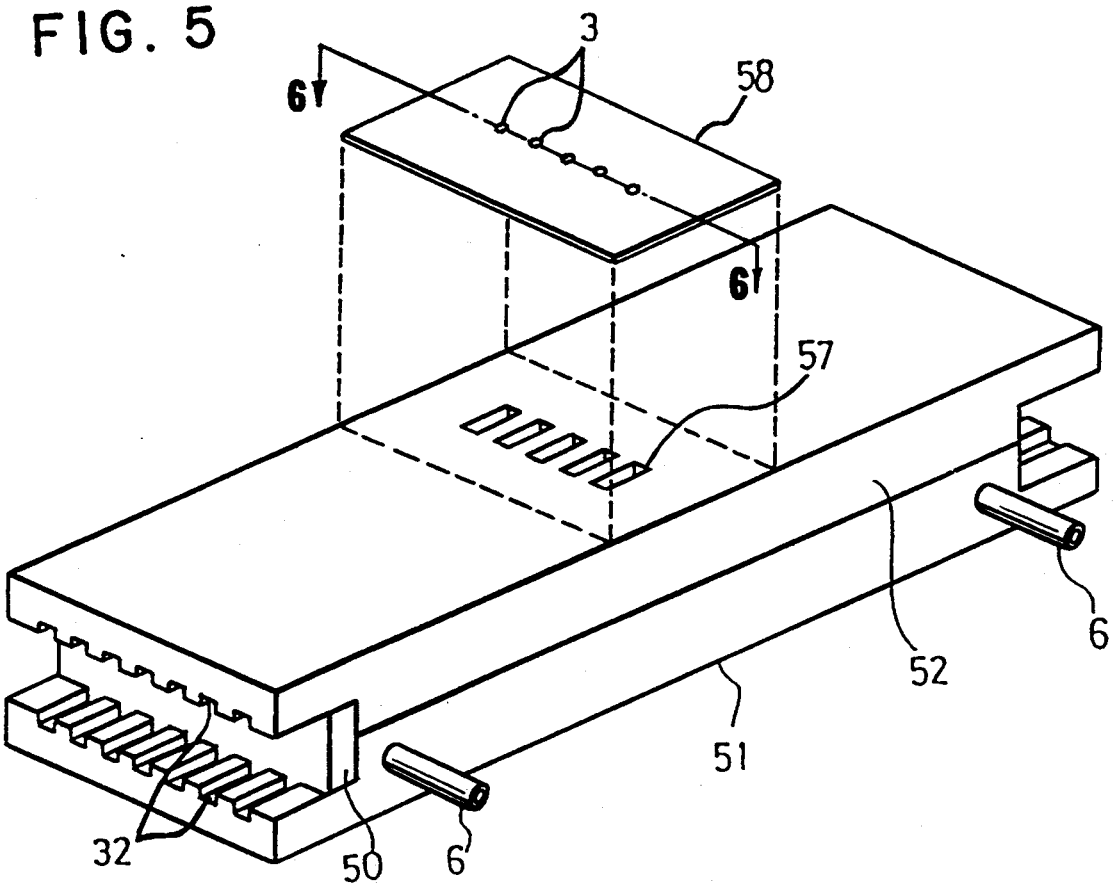
FIG. 5 is a perspective view illustrating the second embodiment of an ink jet head according to the present invention.
Figure 6:
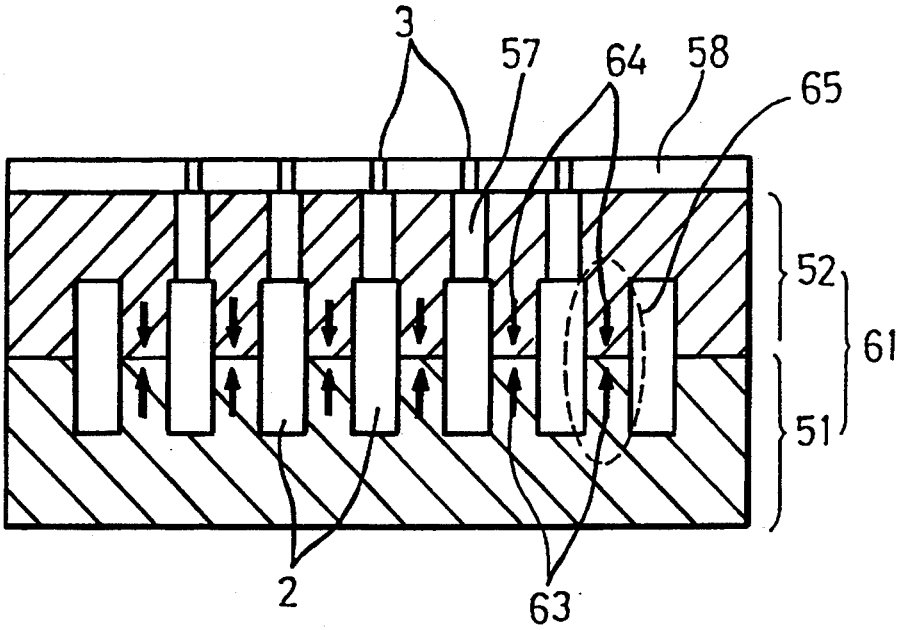
FIG. 6 is a cross-sectional view illustrating the second embodiment of an ink jet head according to the present invention.

FIG. 5 shows another embodiment of the present invention, which is based on the driving principle disclosed in FIG. 2 of Japanese Laid-Open Patent Publication No. 252750/1988. FIG. 6 is a cross-sectional view taken on line 6—6 of FIG. 5. This structure substantially corresponds to the one illustrated in FIG. 1, but the board 1 made of a piezoelectric material used in FIG. 1 is replaced by an integrally molded board 61 which is made by adhering together boards 51 and 52 respectively formed two kinds of piezoelectric materials and whose polarizing directions are inverted with respect to each other as shown by numerals 63 and 64. In this case, the barriers 65 differs from those illustrated in FIGS. 1 to 3 in that they are deformed in dogleg shapes. However, the effects of the nozzle hole arrangement of this embodiment are similar to those described above.

Embodiment 3

Figure 7:
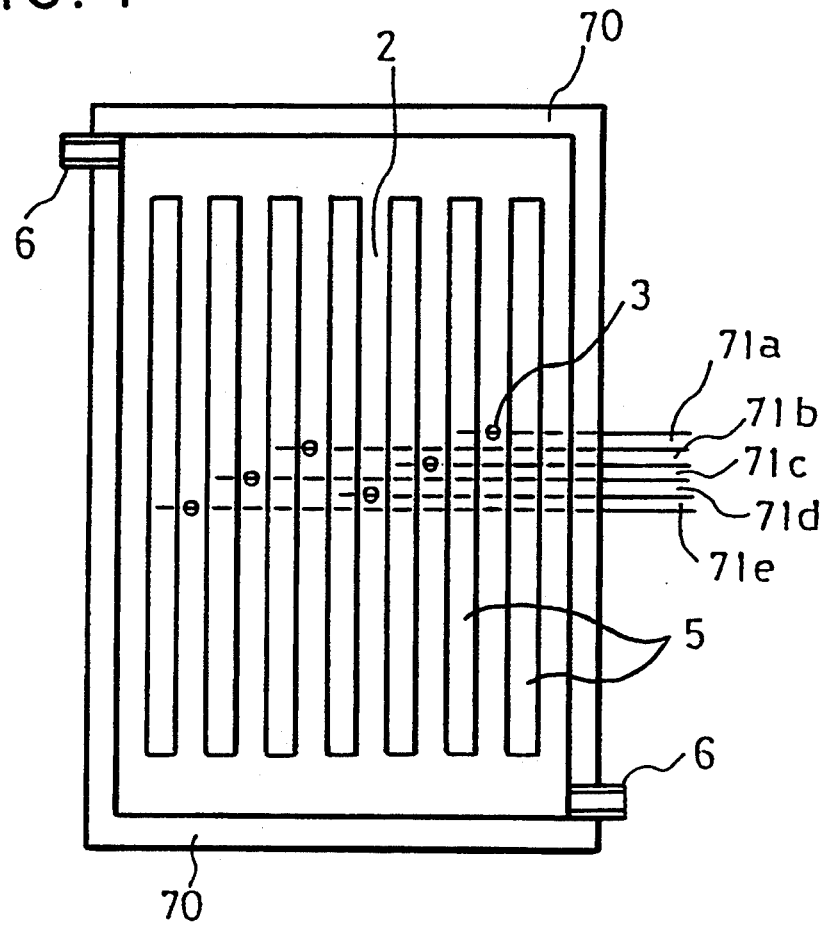
FIG. 7 is a plan view illustrating the third embodiment of an ink jet head according to the present invention.

FIG. 7 shows yet another embodiment of the present invention, wherein the arrangement of the nozzle holes, which are aligned in a straight line in the construction of FIGS. 1 and 5, is changed. In FIG. 1, the dot pitch for printing is determined by the nozzle hole pitches 11*a*, 11*b*, 11*c*, and 11*d* which are arranged at regular intervals along the transverse direction. However, in the case of FIG. 7, the dot pitch for printing is determined by pitches 71*a*, 71*b*, 71*c* and 71*d* along the longitudinal direction. The dot pitches 71*a*, 71*b*, 71*c* and 71*d* have the same value in this embodiment. Thus, the sum of the pitches 71*a*, 71*b*, 17*c* and 71*d* is reduced in comparison with the length of the channels and therefore, the nozzle holes can each be arranged substantially at the centers of the ink channels 2. The important effect of the present invention lies in the possibility that the relation between the pitch of channels and the dot pitch for printing can be independently determined by using such a nozzle arrangement. As a result, the degree of freedom for designing the channel pitch is increased which is valuable in the preparation of the head.

Embodiment 4

Figure 10:
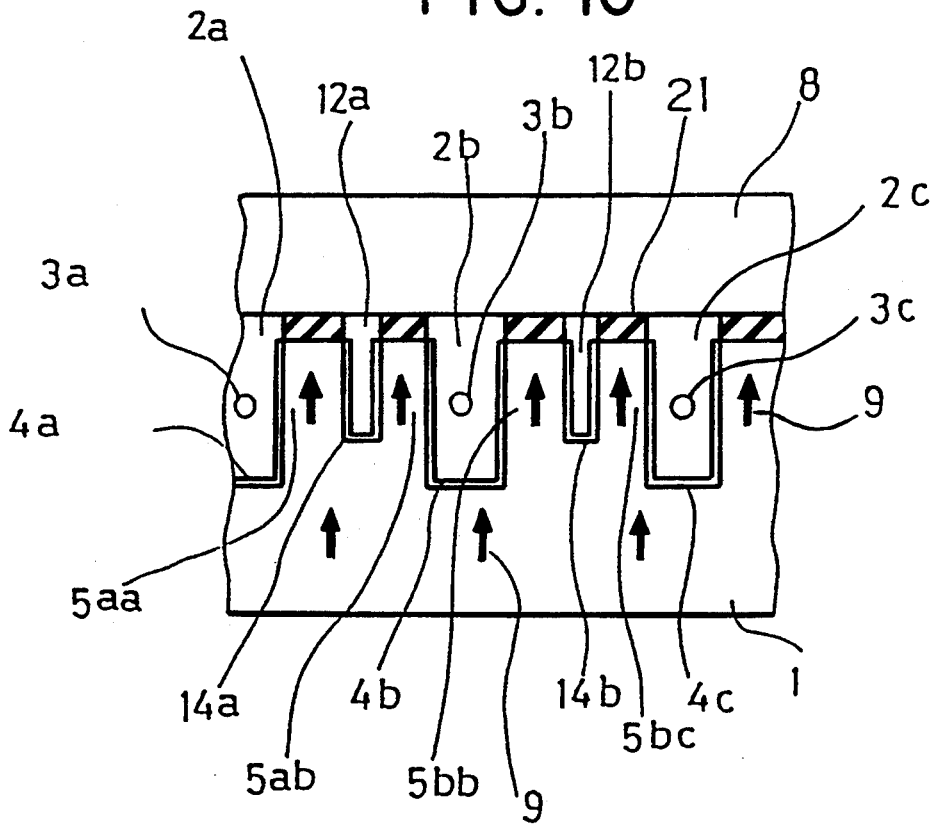
FIG. 10 is a cross-sectional view illustrating a fourth embodiment of an ink jet head according to the present invention.
Figure 16:
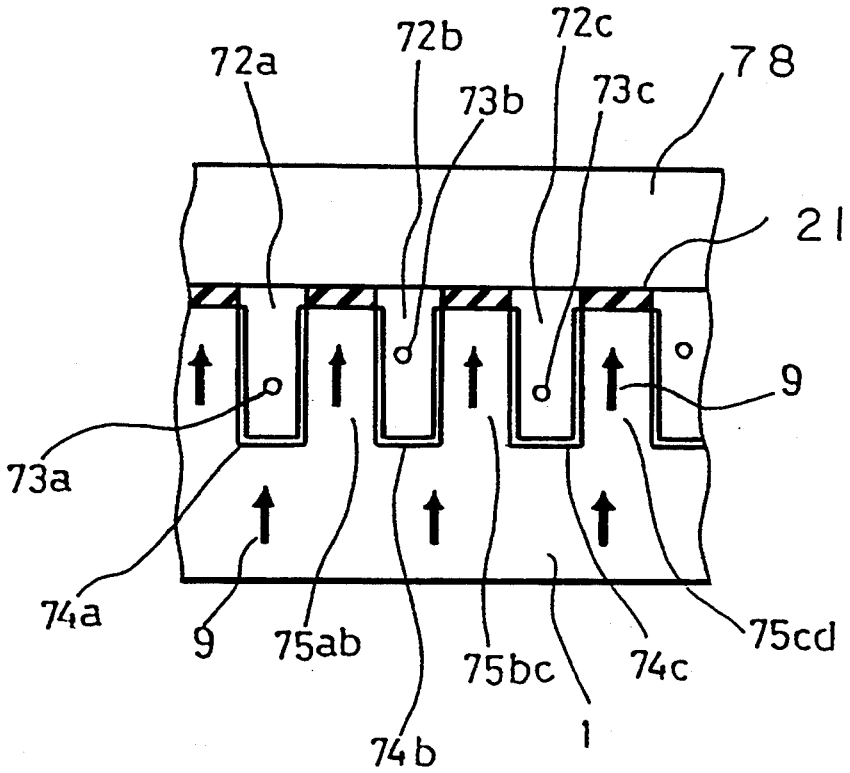
FIG. 16 PRIOR ART
FIG. 16 is a cross-sectional view illustrating the prior art.

FIG. 10 shows an example of an ink jet head structure according to the present invention which corresponds in many respects to the prior art of FIG. 16. Here, ink-ejecting channels 2*a*, 2*b* and 2*c* correspond to the channels 72*a*, 72*b* and 72*c*, respectively. At the end portions of the respective channels, nozzle holes 3a, 3b and 3c are provided as in FIG. 16. The present invention differs from the prior art in that dummy channels 12a and 12b are provided at respective intervals of the channels 2a, 2b and 2c. The depth of the dummy channels is shallower than that of the ink channels 2a, 2b, 2c. The channels 2a, 2b and 2c are filled with ink. The spaces inside the dummy channels 12a and 12b are kept empty. Furthermore, electrodes 4a, 4b, 14a and 14b are formed in the channels on the inner surfaces of the respective barriers.

Figure 11:
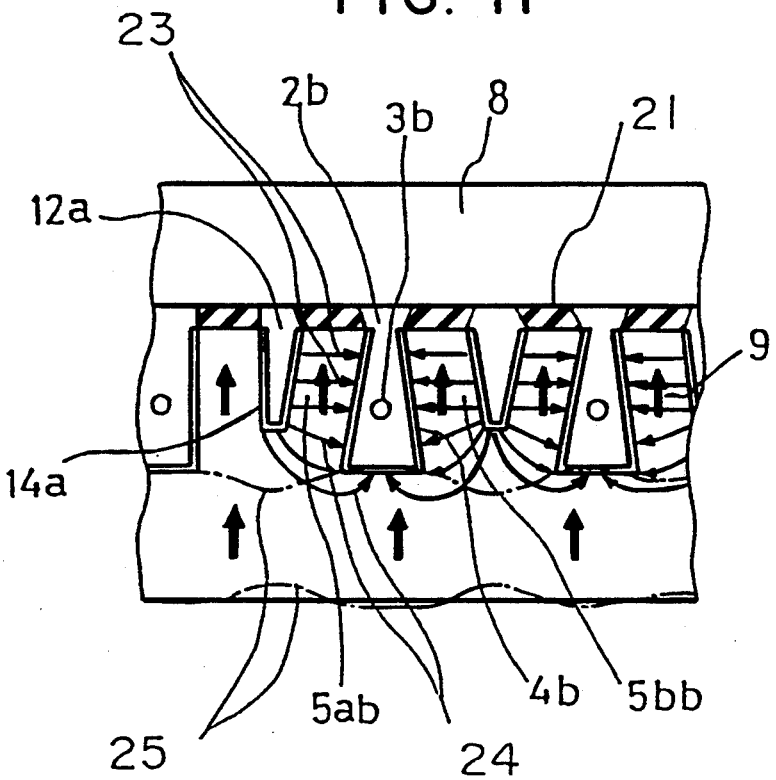
FIG. 11 is a cross-sectional view illustrating a driving state of the fourth embodiment of an ink jet head according to the present invention.
Figure 17:
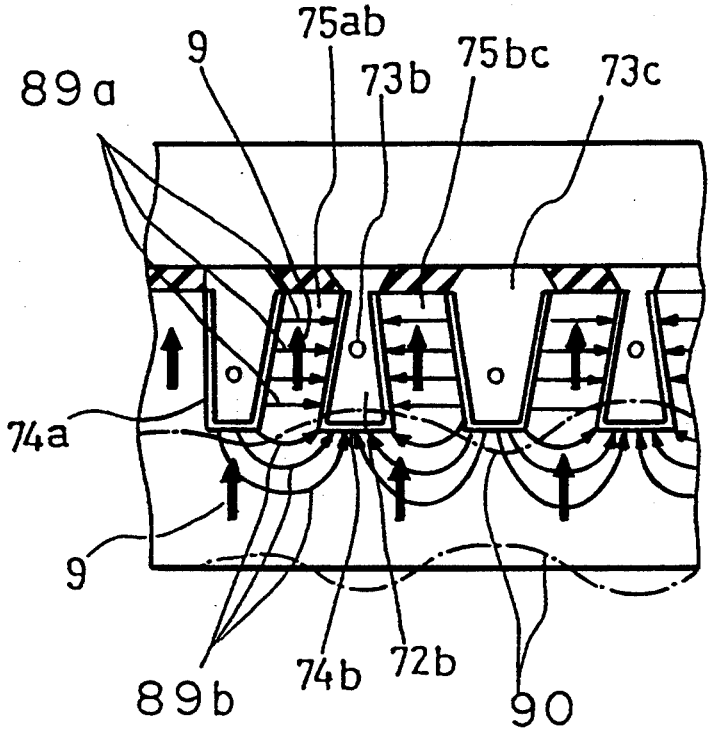
FIG. 17 PRIOR ART
FIG. 17 is a view illustrating a driving state of the prior art.

FIG. 11, which corresponds to FIG. 17, is a view illustrating the operation of the present invention. Here, if a sufficient magnitude of positive electric potential with respect to the electrode 4b is applied to the electrode 14a, the barrier 5ab produces a shear mode deformation similar to that of FIG. 17 due to crossing of the lines of the electric field 23 and the polarization 9 in the barriers. If identical operations are performed on the barrier 5bb, the cross section of the ink-ejecting channel 2b is reduced and an ink droplet is ejected from the nozzle hole 3b in a manner similar to that described in connection with FIG. 17.

The effects of the present embodiment in connection with the suppressing of deformation at the base of the board will now be described. It was described with reference to FIG. 17 that the deformation at the base of the board which acts so as to suppress the shear mode deformation of the barrier is due to the electric field leaked to the base of the board. In FIG. 11, the leaked electric field corresponds to the lines of electric force 24. In this case, the lines of electric force 24 at the bottom portion of the deeper ink channel 2b and the parallel component of the polarization 9 at the bottom portion are so small in comparison with FIG. 17 that they can be ignored. As a result, the stretching deformation toward the thickness direction of the base of the board at and near the bottom portion of the channel 2b is suppressed so that it is very small and its projection at the bottom portion becomes very small as shown by a single dot line 25. On the other hand, the bottom portion of the shallower dummy channel 12a shrinks in the thickness direction to the extent that it substantially corresponds to the prior art. As a result, the structure in accordance with the present invention makes it possible to reduce the deformation amount of the base of the board which has conventionally been a problem to be solved and which acts such that it suppresses the shear mode deformation of the barrier to substantially a half thereof. Though the width of the dummy channel 12a is made shallower than that of the channel 2b, this merely results in the reduction of an unnecessary space, because it is a prerequisite of the present invention that the dummy channel exists as an empty space.

Figure 12:
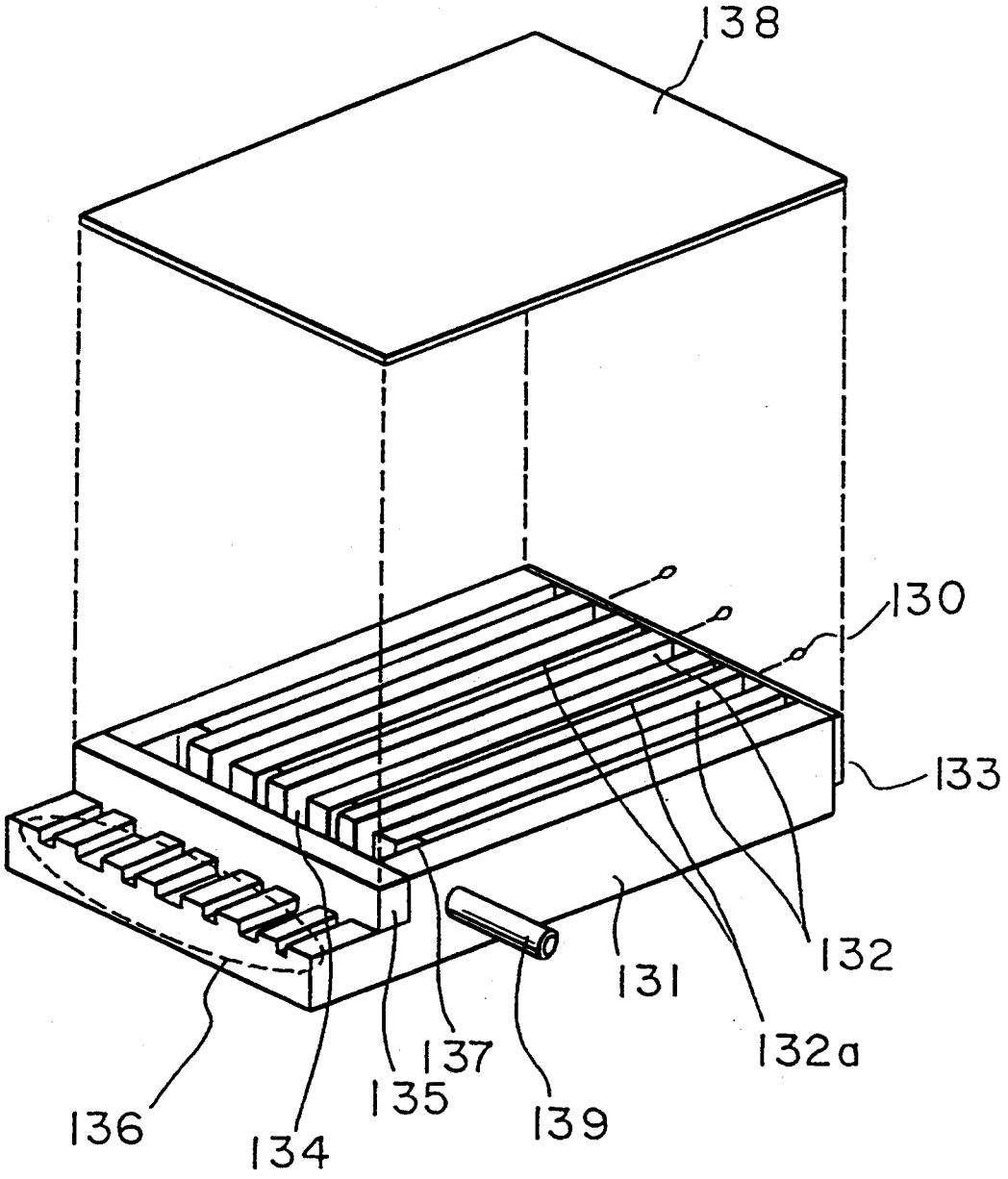
FIG. 12 is a perspective view illustrating the fourth embodiment of an ink jet head according to the present invention.

FIG. 12 is a perspective view illustrating an ink jet head according to the present invention. This head is made by forming on a board 131 made of a piezoelectric material a number of ink channels 132 and a number of dummy channels 132a. Each of the dummy channels has a narrower width and less depth than those of the ink channels 132. The ink channels and the dummy channels are arranged in alternating succession and are parallel to each other. A nozzle plate 133 is adhered at the ends of the ink channels and the dummy channels so as to close the end portions thereof, and the entire portion of the board containing channels is covered with a cover 138. Nozzle holes are formed in the nozzle plate so as to correspond to the end portions of the channels 132 and eject ink droplets. Further, ink is supplied from an ink-supply inlet 139 and is supplied to the ink channels 132 through a common ink reservoir 134. On the other hand, fillers (or plugs) 137 are provided for preventing ink from entering the dummy channels so as to keep them empty. Shallow channel portions 136 are provided at a step portion and are used to provide an electrical connection to the outside. A sealing plate 135 is provided on the step portion so as to prevent ink from escaping from the reservoir.

The head is prepared as follows: A polarized board 131 of PZT having a thickness of 1 mm is subjected to a cutting process by use of a dicing saw to form in alternating succession ink channels 132 having a width of 100 μm and a height of 250 μm and dummy channels 132a having a width of 50 μm and a height of 150 μm. The respective channels have a length of 10 mm. On the inner surfaces of these channels are formed electrodes, comprising laminated films of chromium and gold having a total thickness of 0.8 μm, by means of deposition. A nozzle plate 133 made of stainless steel having nozzle holes, each of which has a diameter of 35 μm, is adhered at the end portions of the channels by use of an epoxy adhesive, and a cover made of plastic is adhered to the upper surfaces of the barriers by intervening elastic members made of a silicone resin, respectively.

So as to confirm the effect in this example, relative ink-ejecting rates were determined with respect to the ink-ejecting rate when both channels have the same depth, by changing a ratio of the depth of the ink channels to the depth of the dummy channels. The experiment was carried out by fixing the depth of the dummy channels at 150 μm and changing the depth of ink-channels. The results are shown in Table 1.

<Table1>

| | | | | | | | |
|---|---|---|---|---|---|---|---|
| depth ratio of channels | 1.0 | 1.1 | 1.2 | 1.4 | 1.6 | 1.8 | 2.0 |
| relative ejecting rate | 1.0 | 1.0 | 1.1 | 1.2 | 1.2 | 1.1 | 0.9 |

In the region where the ratio of the depth of the ink channels to the depth of the dummy channels is great, in effective height of the barriers is reduced and the decrease of deformation amount caused by an original shear mode becomes dominant and thus the ejecting rate finally decreases. On the other hand, in the region where this ratio is small, the lines of electric force and the parallel component of the polarization at the bottom portion of the deeper channel increase and the difference between the present invention and the prior art cannot be recognized. Therefore, this ratio has an optimum range of 1.2 to 1.8.

Embodiment 5

Figure 13:
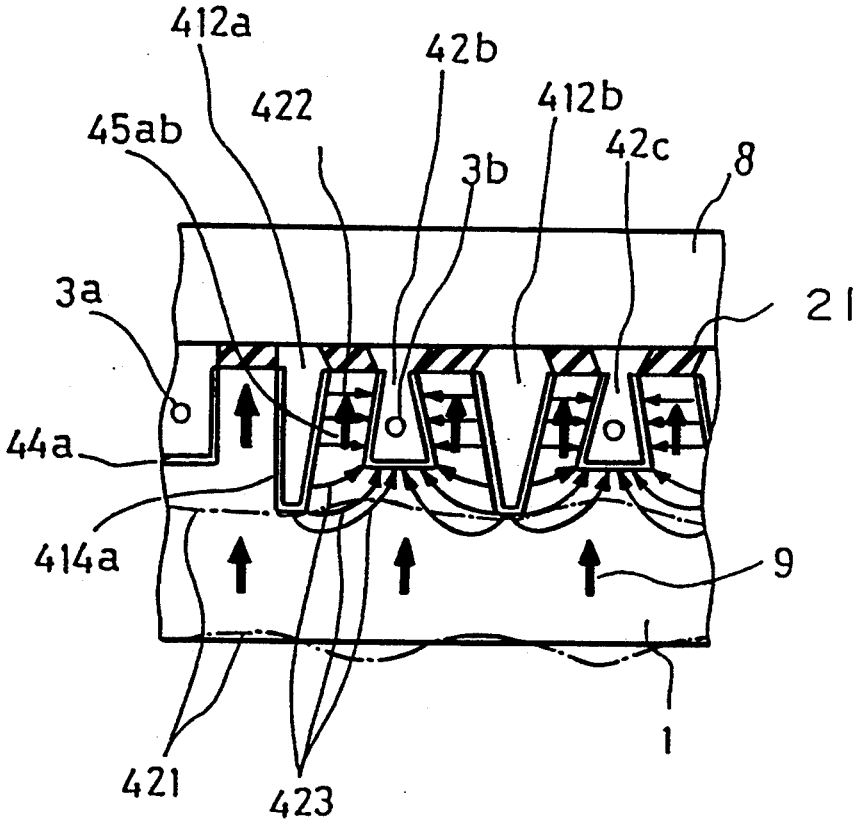
FIG. 13 is a cross-sectional view illustrating a driving state of an ink jet head of a fifth embodiment according to the present invention.

FIG. 13 shows the fifth embodiment of the present invention, wherein dummy channels 412a and 412b have a greater depth than the ink channels 42b and 42c. The other parts are fundamentally similar to the embodiment shown in FIG. 10. FIG. 13 illustrates the structure when being driven, which corresponds to FIG. 11. In a manner similar to the prior art, due to a leaked electric field at the base of the board, a stretching deformation is produced at the bottom portion of the shallower ink channel 42b as shown by a single dot line 421 to protrude from the bottom portion. On the other hand, no deformation is produced at the bottom portion of the deeper dummy channel, for the same reason which was explained with reference to FIG. 11 which contributes to the improvement in the ink-ejecting force.

An experiment was carried out so as to confirm the effect of this embodiment similar to the one shown in Table 1. The results are shown in Table 2.

<Table 2> depth ratio of channels 0.5 0.7 0.8 0.9 1.0
relative ejecting rate 1.2 1.2 1.1 1.1 1.0

In this example, since the effective height of the barrier 45*ab* is made constant and the deformation at the bottom portion of the dummy channel 412*a* can be ignored in the region where the depth ratio of the ink channel to the dummy channel is small, the ejecting rate finally has a constant value. On the other hand, in the region where the ratio is close to 1, the lines of electric force and the parallel component of the polarization increases at the bottom portion of the deeper channel and its difference from the prior art cannot be recognized. Accordingly, the ejecting characteristics are improved, relative to the prior art, for any value of this ratio. However, the ratio preferably has a value of 0.8 or less.

Embodiment 6

Figure 14:
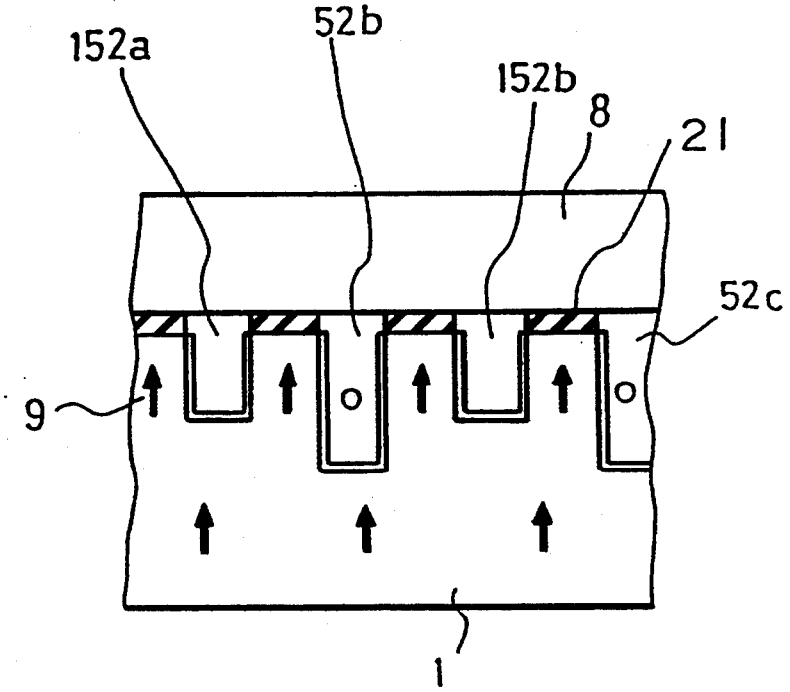
FIG. 14 is a cross-sectional view illustrating a sixth embodiment of an ink jet head according to the present invention.

FIG. 14 shows a sixth embodiment of the present invention, wherein the width of a dummy channel 152*a* is similar to the width of an ink channel 52*b*. The remaining construction is similar to that illustrated in FIG. 11. Thus, for this construction, it will be apparent that the explanation of the present invention with reference to FIGS. 10 and 11 can be applied to the present embodiment. This embodiment has the advantage that, when a cutting process is carried out by using a dicing saw as was explained in connection with the method of production of the FIG. 10 construction, the same blade can be used for cutting the dummy channels and the ink channels and thus the manufacturing process can be made more efficient.

Embodiment 7

Figure 15:
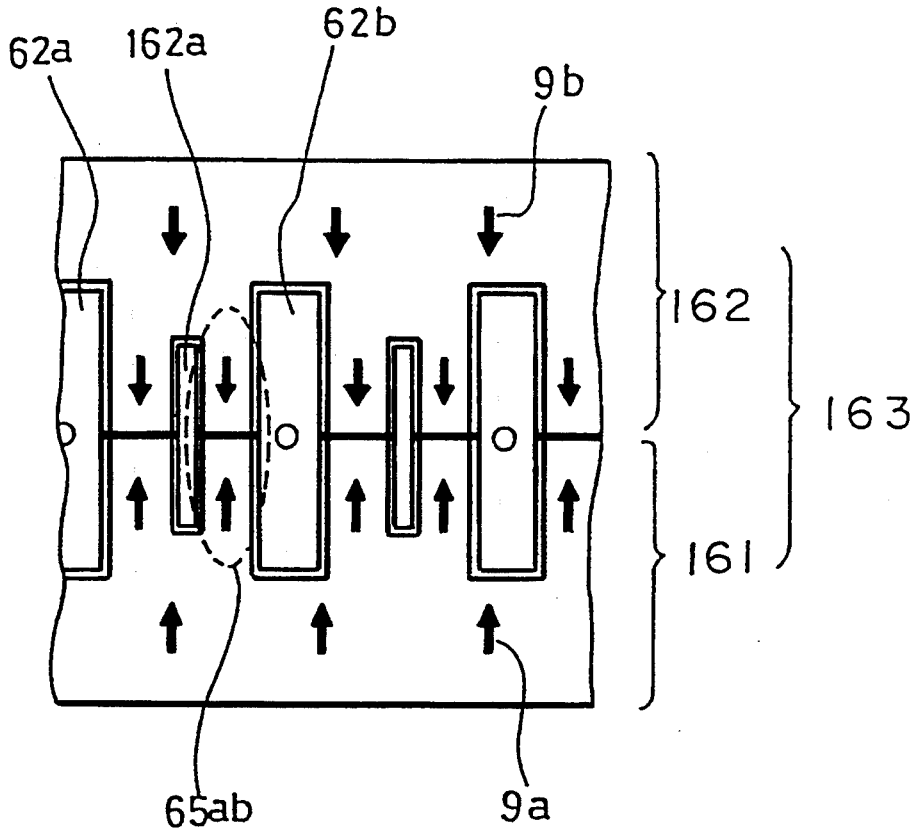
FIG. 15 is a cross-sectional view illustrating a seventh embodiment of an ink jet head according to the present invention.

FIG. 15 shows a seventh embodiment of the present invention, which is based on the driving principle disclosed in FIG. 11 of Japanese Laid-Open Patent Publication No. 252750/1988. This structure substantially corresponds to the one illustrated in FIG. 10, but the board 1 made of a piezoelectric material used in FIG. 10 is replaced by an integrally molded board 163 which is made by adhering boards 161 and 162 formed of two kinds of piezoelectric material and whose polarizing directions 9*a* and 9*b* are opposite one another. This structure comprises ink channels 62*a* and 62*b* and dummy channels 162*a*. The barriers 65*ab* differ from the barriers illustrated in FIG. 11 in that they deform into dogleg shapes. However, this embodiment exhibits the same effects as the present invention described in FIG. 11.

EFFECTS OF THE INVENTION

By disposing nozzle holes substantially at the central portions of the channels and supplying ink from both sides of the channels, the influence of fluid resistance in the channels is greatly decreased such that the amount of resistance, relative to the prior art is reduced by half due of the effective length of the channels and is again reduced by half due to the effective number of effective channels. Thus, the fluid resistance is reduced to one-quarter of that present in the conventional structure. As a result, the decrease in ejecting power of ink droplets resulting from the fluid resistance is greatly reduced and, thereby, it is possible to obtain an ink jet head which has excellent ink ejecting characteristics.

Accordingly, the structure of the present invention significantly improves the problem of the decrease in ejecting force caused by fluid resistance in the ink channels, which has been an important problem to be solved for shear mode ink jet heads. As a result, a head having stable printing quality can be obtained. Incidentally, though the ink jet head disclosed in Japanese Laid-Open patent Publication No. 252749/1988 resembles the present invention in construction, it will be apparent from the above description that the present invention differs from that in purpose, effect and construction.

The above-described undesirable effects caused by the leaked electric field at the base of the piezoelectric board according to the prior art can be suppressed by changing the depths of channels on opposing sides of the barriers to which a voltage is applied, as described in connection with Embodiments 4–7, as described hereafter. However, in the conventional structure, the sizes of the respective channels must be made identical to provide uniformity in the ink ejecting characteristics, and thus an arrangement such as in the present invention cannot be used. In the structure of the present invention, shear mode deformation of the barriers is produced by the voltage applied between the electrodes in the dummy channels and the electrodes in the ink channels, and thus the depth of the dummy channels can be designed to be different than the depth of the ink channels. The result of providing different depths for the channels is based on the fact that the deformation at the base of the conventional board can be ignored for the most part due to substantial crossing of the leaked electric field and the polarization at the bottom portion of the deeper channel, while the interaction of the leaked electric field and the polarization at the shallower channel is substantially similar to the conventional structure. Thus, the deformation amount at and near the bottom portion of the channel, which has the effect of suppressing deformation in the shear mode, can be reduced to substantially half. Thereby, the deformation amount of the barriers can be ensured to obtain an ink jet head with excellent in ink ejecting characteristics.

Accordingly, the structure in accordance with the present invention can greatly reduce suppression of shear mode deformation of the barriers caused by the leakage of the electric field to the base of the piezoelectric board in a shear mode type ink jet head. As a result, the ink ejecting capability is improved, which makes it possible to obtain a head having a stable printing quality.

We claim:

1. An ink jet head comprising:

a base member formed of piezoelectric material;

a plurality of elongated members formed of piezoelectric material and being mounted on said base member, said elongated members being spaced apart from one another so as to define therebetween a plurality of elongated channels, first alternating ones of which said elongated channels constituting ink-receiving channels and having a first depth, and second alternating ones said elongated channels having a second depth different than said first depth;

electrodes formed in said channels on opposing sides of said elongated members;

a channel closing member mounted to said elongated members to cover portions of said channels, said channel closing member having nozzle holes respectively formed therein in alignment with at least some of said channels;

wherein said elongated members and said electrodes comprise an ink jetting means for selectively jetting ink from said nozzle holes by selectively changing volumes of said channels by shear mode deformation of selected ones of said elongated members, upon application of a drive voltage to selected ones of said electrodes; and wherein a common ink reservoir is formed at first ends of said channels.

2. An ink jet head as recited in claim 1, wherein a ratio of said first depth to said second depth is in a range of 1.2 to 1.8.

3. An ink jet head as recited in claim 1, wherein a ratio of said first depth to said second depth is greater than zero, and is 0.8 or less.

4. An ink jet head as recited in claim 1, wherein alternating ones of said plurality of elongated channels are hollow.

5. An ink jet head as recited in claim 4, wherein at least one plug is provided for each of said alternating ones of said plurality of elongated channels to prevent ink from entering thereinto.

* * * * *